US008267202B2

(12) United States Patent
Connell

(10) Patent No.: US 8,267,202 B2
(45) Date of Patent: Sep. 18, 2012

(54) FEED CHAIN AUTOMATIC TENSIONER

(75) Inventor: Stuart Austin Connell, Sherman, TX (US)

(73) Assignee: Caterpillar Global Mining Equipment LLC, South Milwaukee, WI (US)

( * ) Notice: Subject to any disclaimer, the term of this patent is extended or adjusted under 35 U.S.C. 154(b) by 373 days.

(21) Appl. No.: 12/721,950

(22) Filed: Mar. 11, 2010

(65) Prior Publication Data

US 2011/0220420 A1 Sep. 15, 2011

(51) Int. Cl.
*E21B 19/086* (2006.01)

(52) U.S. Cl. ..... 175/122; 175/162; 474/110

(58) Field of Classification Search ..... 175/122, 175/162; 92/107–109; 474/109, 110, 113, 474/114, 136–138; 254/277; 81/57.38, 486
See application file for complete search history.

(56) References Cited

U.S. PATENT DOCUMENTS

| | | | | | |
|---|---|---|---|---|---|
| 2,029,223 | A | | 1/1936 | Curtis | |
| 2,338,625 | A | | 1/1944 | Curtis | |
| 2,356,899 | A | * | 8/1944 | Stutter | 92/108 |
| 2,365,749 | A | | 12/1944 | Curtis | |
| 2,564,188 | A | | 8/1951 | Burg et al. | |
| 2,832,567 | A | | 4/1958 | Fletcher et al. | |
| 2,877,005 | A | * | 3/1959 | Silks | 299/59 |
| 3,403,552 | A | * | 10/1968 | Erisman | 73/862.42 |
| 3,422,692 | A | * | 1/1969 | Woodring | 474/136 |
| 3,647,270 | A | * | 3/1972 | Althaus | 305/146 |
| 3,664,717 | A | * | 5/1972 | Pendergrass et al. | 384/519 |
| 3,867,989 | A | | 2/1975 | Hisey et al. | |
| 4,303,132 | A | | 12/1981 | Weber | |
| 4,434,860 | A | * | 3/1984 | Deyo | 173/147 |
| 4,434,868 | A | | 3/1984 | Brenner et al. | |
| 4,456,077 | A | | 6/1984 | Lagerstedt et al. | |
| 4,540,159 | A | * | 9/1985 | Jordan | 254/228 |
| 4,865,516 | A | | 9/1989 | Focke et al. | |
| 4,998,453 | A | * | 3/1991 | Walton et al. | 81/57.38 |
| 5,000,271 | A | | 3/1991 | Uitto et al. | |
| 5,226,488 | A | | 7/1993 | Lessard et al. | |
| 5,294,318 | A | | 3/1994 | Grant, Jr. et al. | |
| 5,844,133 | A | | 12/1998 | Goto et al. | |
| 6,200,036 | B1 | * | 3/2001 | Girardey | 384/260 |
| 6,216,797 | B1 | | 4/2001 | Draney et al. | |
| 6,672,410 | B2 | * | 1/2004 | Smith | 175/122 |
| 2003/0056988 | A1 | * | 3/2003 | Smith | 175/57 |
| 2008/0110676 | A1 | | 5/2008 | Deutsch et al. | |

FOREIGN PATENT DOCUMENTS

| | | |
|---|---|---|
| JP | 11-241586 | 9/1999 |

OTHER PUBLICATIONS

International Search Report and Written Opinion for International Application No. PCT/US11/25007, mail date Sep. 7, 2011, 6 pages.

* cited by examiner

*Primary Examiner* — William P Neuder
*Assistant Examiner* — Blake Michener
(74) *Attorney, Agent, or Firm* — Foley & Lardner LLP

(57) ABSTRACT

An automatic tensioning system for a chain drive system of a rock drill assembly is disclosed. A hydraulic cylinder is coupled to one end of the feed channel of a rock drill assembly. When pressurized hydraulic fluid is provided to the hydraulic cylinder, a plunger within the hydraulic cylinder pulls on a tensioner sprocket, which in turn provides tension to the chain of the chain drive system. This allows for a constant tension to be applied to the chain throughout a long duration of operation as opposed to a manually adjusted chain drive system in which the chain tension varies during operation in between manual adjustments.

20 Claims, 4 Drawing Sheets

FEED CHAIN AUTOMATIC TENSIONER

BACKGROUND

1. Field

The present disclosure relates generally to rock drilling units for drilling deep holes and the tensioning system on the chain drive for such drilling units.

2. Background

Some rock drills translate along a feed channel which supports the drill as the drill bit digs deeper within rocky earth or other material. The feed channel is tens of feet long. A drill bit is connected to the rock drill by one or more drill rods. When the rock drill is at the bottom of travel along the feed channel, the rock drill is pulled out and an additional drill rod is installed in between the drill bit and the rock drill. Drilling recommences with the rock drill at the end of the feed channel which is farther away from the hole being drilled. As drilling continues, the rock drill moves along the feed channel until it is once again at the bottom of travel.

The rock drill moves along the feed channel by a chain drive system. One end of a chain is connected to one end of the rock drill and the other end of the chain to the other end of the rock drill. The chain and rock drill form a loop which is looped over an idler sprocket coupled to one end of the feed channel and a tensioner sprocket at the other end of the feed channel. The chain further engages with a drive sprocket of a chain feed drive. The chain feed drive controls the movement of the rock drill along the feed channel as well as providing a force on the rock drill in the direction of the drill bit, i.e., to provide force on the drill bit to facilitate the drill bit in grabbing onto the material into which a hole is being drilled.

Proper operation of the chain drive system is ensured by maintaining a specified chain tension in the chain so that the chain does not jump teeth of the sprockets and by replacing the chain when it has stretched beyond a predetermined amount. In some systems, the tension is adjusted manually prior to putting the drill unit in service for a shift. Although such practice is desirable, not all drill operators remember to perform such maintenance regularly. Furthermore, in a situation where the drill unit is operated continuously for long periods of time, the chain may stretch sufficiently since the last adjustment so that the chain jumps a tooth during a single shift. Damage to the sprocket and surrounding hardware can occur in a single instance of the chain jumping off the sprocket. Once the chain jumps a first time, it is likely to regularly jump off the sprocket because the tension in the chain is insufficient to hold the chain within teeth of the sprocket.

Another maintenance issue associated with such rock drills is in providing an indication of when chain replacement is recommended.

SUMMARY

To address at least one problem, a rock drill assembly is disclosed which has a feed channel with a guide rail on which a rock drill can translate. A tensioner member is movably coupled to the feed channel. A chain feed drive with a drive sprocket is also coupled to the feed channel. A chain attached to the rock drill engages the tensioner member and the drive sprocket. An automatic actuator associated with the tensioner member applies a constant tensioning force to the tensioner member to tension the chain. The tensioning member may include a clevis and a tensioning sprocket, with the chain engaging with the tensioning sprocket. The automatic actuator may include an electric motor or a hydraulic cylinder. The hydraulic cylinder may have an inlet port with a check valve coupled to the inlet port. In one embodiment, pressurized hydraulic fluid is supplied via the check valve. A plunger within the hydraulic cylinder may translate with respect to a body of the hydraulic cylinder when pressurized hydraulic fluid is supplied to the hydraulic cylinder. In another embodiment, the hydraulic cylinder is a through-bore hydraulic cylinder. The rock drill assembly may also include a rod coupled between the tensioner member and the hydraulic cylinder in which one end of the rod extends through the through-bore hydraulic cylinder to which an adjusting nut is coupled. In such embodiment, the nut engages with the plunger such that when a force is applied to the plunger due to the hydraulic pressure with the hydraulic cylinder, the force is transmitted to: the rod via the adjusting nut, to the tensioner member, and ultimately to the chain. A washer may be placed between the adjusting nut and the hydraulic cylinder. Furthermore, a locking nut can be placed on the rod to assist in maintaining the position of the adjusting nut.

According to another embodiment, a rock drill assembly has a feed channel with a guide rail. The rock drill moves along the guide rail. The feed channel has an idler sprocket and a clevis moveably coupled to the feed channel. The position of the clevis, with respect to the feed channel, affects chain tension. A tensioner sprocket is mounted on the clevis. A chain feed drive coupled to the feed channel has a drive sprocket. A chain is connected at both ends of the rock drill and looped around the idler, tensioner, and drive sprockets. When the chain feed drive is operated, the chain may cause the rock drill to translate along the feed channel, with the direction depending on the chain feed drive rotation direction. In some embodiments, an automatic actuator is associated with the feed channel to provide chain tension. The automatic actuator may be a hydraulic cylinder or an electric motor, which acts upon the clevis and the tensioner sprocket to control the tension in the chain. In some embodiments, the automatic actuator is a through-bore hydraulic cylinder with threaded rod coupled to the member at a first end and extending through the through-bore hydraulic cylinder at a second end. In such an embodiment, the threaded rod has an adjusting nut which can transmit force from the plunger to the threaded rod. The through-bore hydraulic cylinder may include a hydraulic fluid inlet port, a check valve coupled to the hydraulic fluid inlet port, and a hydraulic line coupled to the check valve. The plunger is forced toward the adjusting nut when pressurized hydraulic fluid is provided to the through-bore hydraulic cylinder thereby pulling on the threaded rod and providing tension in the chain. A washer may be included between the plunger and the adjusting nut. Furthermore, a lock nut can be included on the threaded rod locking against the adjusting nut to prevent the adjusting nut from backing off the threaded rod. The rock drill assembly may further include a drive idler sprocket coupled to the chain feed drive or the feed channel and the chain engages with the drive idler sprocket.

In some embodiments, a mark is provided on the feed channel in the vicinity of the member (in one embodiment, a clevis) such that an upper surface of the clevis is roughly coincident with the mark on the feed channel when the chain is stretched to an amount to indicate chain replacement. Upon installation of a replacement chain, the chain length and other adjustments are made so that the top surface of the clevis is at a predetermined distance away from the mark so that the top surface of the clevis being coincident with the mark on the feed channel provides a reliable measure of chain stretch at which the chain should be replaced. Alternatively, or additionally, a switch is provided the feed channel with a pin of the switch actuated by the clevis when the clevis moves toward the hydraulic cylinder a predetermined amount. Switch actuation indicates chain replacement. The switch can be coupled to an electronic device which provides such indication. In one embodiment, the switch is electronically coupled to the chain feed drive to shut down operation. In another embodiment, the electronic device provides an indicator, such as illuminating a lamp, sounding an alarm, or setting a code in an electronic control unit.

By providing a hydraulic cylinder onto the end of the feed channel, per an embodiment of the disclosure, and providing pressurized hydraulic fluid to the hydraulic cylinder, the chain tension is automatically adjusted and remains constant as the chain wears. This prevents damage to the sprockets and other rock drill assembly hardware when the chain becomes too loose and jumps a tooth or when the chain is tightened beyond the recommended tension and causes the chain to break.

In some embodiments, a manually-operated three-way valve is included between the check valve and hydraulic cylinder. The three-way valve allows flow between the check valve and the hydraulic cylinder when in a first position for normal operation and allows flow between the hydraulic cylinder and a bleed off line when in a second position for chain replacement. Having such a valve facilitates to relieve the pressure in the system alleviates chain tension so that the chain can be removed and replaced.

According to some embodiments, an indicator of when the chain needs to be replaced, in the form of a mark or an electrical indicator, is provided. This presents an advantage over maintenance being performed after a certain number of hours of operation, since the number of hours must be set to the number of hours under the most demanding operation, which results in maintenance being performed more often than necessary in most instances. The visual indication, according to an embodiment herein, also presents an advantage over basing maintenance on a difficult measurement, especially ones requiring special tools or measurement devices.

Also disclosed is a method to retrofit a rock drill assembly from a manual tensioning system to one with automatic tensioning. According to one embodiment of the disclosure, the existing manually-adjusted tensioning system is disassembled by removing an adjusting nut from a threaded rod which is coupled to the guided clevis onto which a tensioning sprocket is mounted. An automatic actuator is coupled to the threaded rod. In one embodiment, the automatic actuator is through-bore hydraulic cylinder which is slid over the threaded rod. If the threaded rod is not long enough to accommodate the hydraulic cylinder, a longer threaded rod is installed in the place of the existing threaded rod, i.e., the threaded rod associated with the manually-adjusted tensioning system. An adjusting nut is placed on the threaded rod and it is tightened to snug it to the hydraulic cylinder. A hydraulic supply line is connected to an inlet of the through-bore hydraulic cylinder.

An advantage according to the present disclosure is that an automatic tensioning system can readily be retrofit onto an existing rock drill assembly, which is particularly useful in work locations where the manual tension adjustments are not performed regularly.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for explanation of the invention. However, various combinations and modifications of the features consistent with the teachings of the present disclosure may be desired for particular applications or implementations. Those of ordinary skill in the art may recognize similar applications or implementations consistent with the present disclosure, e.g., ones in which components are arranged in a different order than shown in the embodiments in the Figures, some components are removed or other components are added to the invention. Those of ordinary skill in the art will recognize that the teachings of the present disclosure may be applied to other applications or implementations.

Figure 1:
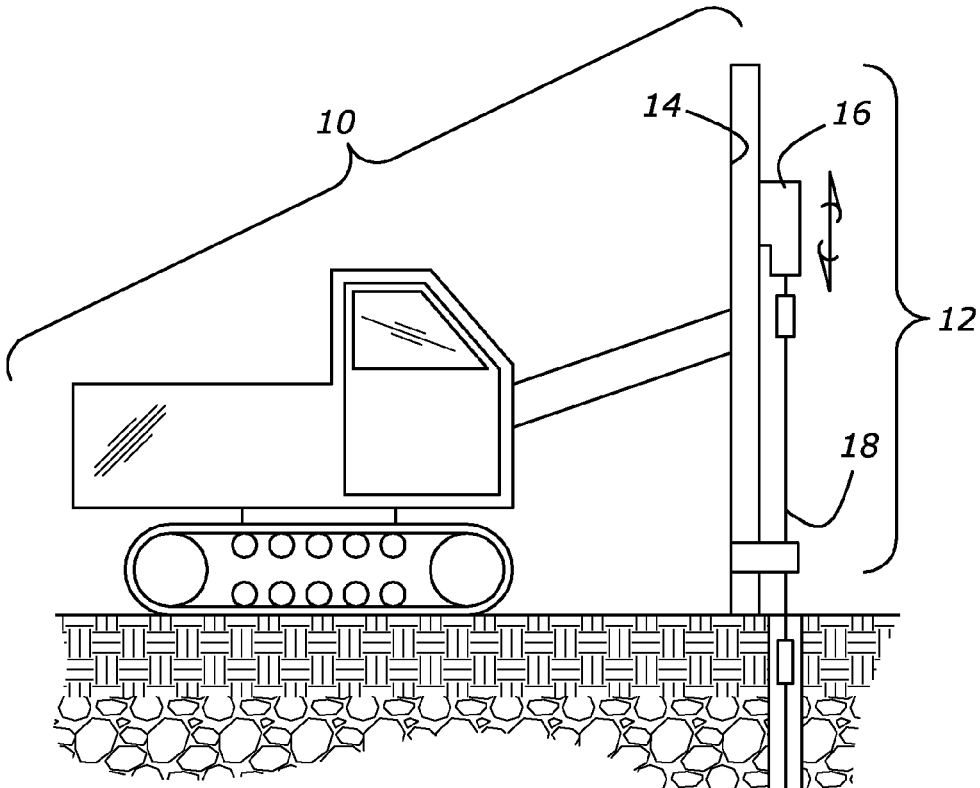
FIG. 1 is sketch of a rock drill in use.

FIG. 1 shows a drill unit 10 including a rock drill assembly 12 mounted thereon. The drill unit 10 may hold the rock drill assembly 12 in a mostly vertical manner, for example, during use and allows for transport and positioning of rock drill assembly 12. Rock drill assembly 12 includes a feed channel 14 on which a rock drill 16 moves lengthwise (shown as vertical in FIG. 1, but can be positioned at any angle). One or more drill rods 18 are coupled to rock drill 16. A drill bit 20 coupled to one drill rod 18 is placed into the ground and fractures the rock so that the rock can be removed and the hole can be extended further. Rock drill 16 moves along feed channel 14 to move drill bit 20 down as drill bit 20 makes the hole deeper. However, when rock drill 16 reaches the lower end of feed channel 14, rock drill 16 is disconnected from drill rod(s) 18 and moved to the top of feed channel 14. Another section of drill rod 18 is added between rock drill 16 and existing drill rod(s) 18 and drilling resumes.

As shown in FIG. 1, a hole is being drilled downward. However, this is not intended to be limiting and the hole can be drilled in any direction. For example, within a mine, drill unit 10 can be used to install expansion anchors in a roof of a mine shaft to prevent collapse.

Accordingly, the terms "up" and "down" and other directional terms are merely provided for purposes of illustration and are not limiting of the teachings herein.

Figure 2:
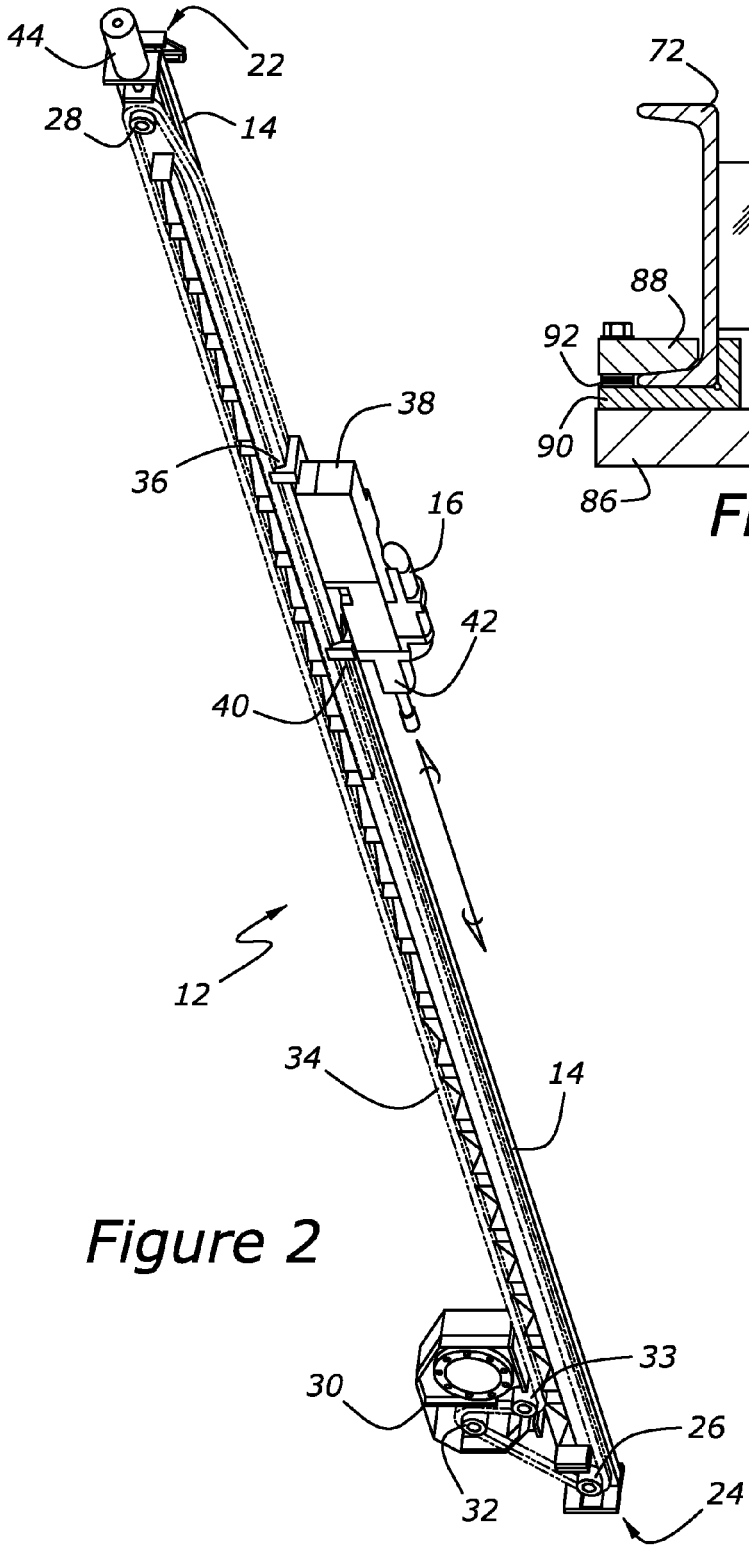
FIG. 2 is cross-section of a rock drill assembly.

In FIG. 2, a cutaway of an embodiment of the rock drill assembly 12 is shown, with feed channel 14 having a first end 22 and a second end 24. Feed channel 14 also has one or more guide rails (shown in FIGS. 4 and 5, denoted by reference number 72) on which rock drill 16 moves. A lower idler sprocket 26 is coupled to feed channel 14 at lower end 24 and a tensioner sprocket 28 is coupled to feed channel 14 at upper end 22. A chain feed drive 30 having a drive sprocket 32 and a drive idler sprocket 33 is coupled to feed channel 14. A chain 34 is attached to rock drill 16 with a first end 36 of chain 34 coupled to an upper end 38 of rock drill 16 and a second end 40 of chain 34 coupled to a lower end 42 of rock drill 16. Chain 34 and rock drill 16 form a loop with the chain wrapping around lower idler sprocket 26, drive idler sprocket 33, tensioner sprocket 28, and drive sprocket 32. A through-bore hydraulic cylinder 44 adapted to tension chain 34 is coupled to upper end 22 of feed channel 14. Various components of the drill assembly 12 collectively provide a tensioning member, as will become apparent in light of the disclosure as a whole.

In one embodiment, chain feed drive 30 is driven with an electric motor. Alternatively, chain feed drive 30 is driven with a hydraulic motor. In yet another embodiment, chain feed drive 30 includes an internal combustion engine. Any device that provides adequate rotational energy may be used to drive the chain feed drive 30.

Figure 3:
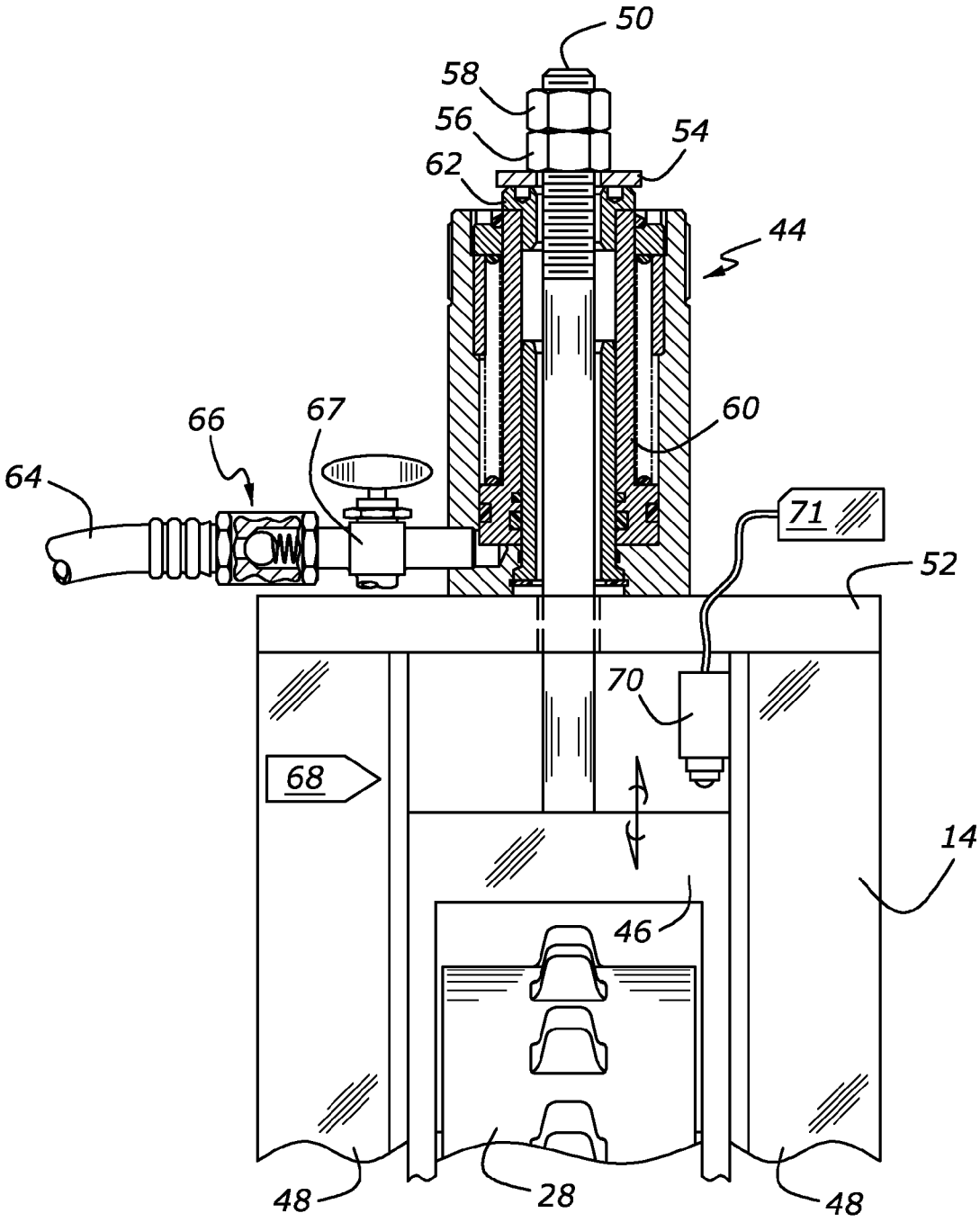
FIG. 3 shows a cross-section of an automatic chain tensioner system according to an embodiment of the disclosure.

An embodiment of the upper end 22 of feed channel 14 is shown in detail in FIG. 3. A guided clevis 46 is mounted within and can slide along guide rails 72 of feed channel 14. Tensioner sprocket 28 is coupled to guide clevis 46. A first end of a threaded rod 50 is mounted to guide clevis 46. Threaded rod 50 extends through feed upper plate 52 and through through-bore hydraulic cylinder 44. A second end of threaded rod 50 extends above through-bore hydraulic cylinder 44 where it is fixed with a washer 54, a preload adjusting nut 56, and a preload locknut 58. Chain tension may be maintained by movement of a plunger when through-bore hydraulic cylinder 44 is supplied pressurized hydraulic fluid. The plunger includes a cylindrical portion 60 coupled to an upper plunger portion 62. Cylindrical portion 60 and upper plunger 62 are threaded, welded, press-fit, or coupled in any suitable manner. Alternatively, the plunger can be formed out a single piece of material. Pressurized hydraulic fluid is supplied through a hydraulic line 64 coupled to through-bore hydraulic cylinder 44. A check valve 66 at the inlet to hydraulic cylinder 44 prevents loss of tension with loss of hydraulic pressure in hydraulic line 64.

Some embodiments employ a hydraulic cylinder to supply tension on the chain. As hydraulic fluid at a relatively constant pressure is commonly available on the drill unit, these embodiments are often economic to implement. By knowing the supply pressure of the hydraulic fluid, the hydraulic cylinder can be properly sized to provide the desired chain tension.

In one embodiment, through-bore hydraulic cylinder 44 is mounted to feed upper plate 52 via any suitable manner. In an alternative embodiment, through-bore hydraulic cylinder 44 sits upon feed upper plate 52 and is held in place via nuts 56 and 58 acting upon washer 54. An advantage according to embodiments of the disclosure is that through-bore hydraulic cylinder 44 can be easily retrofit onto prior art systems in which tension was adjusted manually.

A manually operated three-way valve 67 is included in between check valve 66 and the inlet to through-bore hydraulic cylinder 44 in some embodiments. To facilitate replacing chain 34, tension within the system is relieved by opening valve 67 to relieve the pressure within hydraulic cylinder 44.

Chain 34 stretches over time while the rock drill assembly is being operated. Operation with excessive chain stretch can cause damage to the rock drill assembly. Thus, proper maintenance includes replacing chain 34 when it has stretched a predetermined amount. In one embodiment, a mark 68 is provided on feed channel 14. When a top surface of guided clevis 46 is substantially lined up with mark 68, chain replacement is indicated. In another embodiment, a limit switch 70 is mounted on feed channel 14. Limit switch could be optical, magnetic, a pin switch, or any suitable switch. When guided clevis 46 activates limit switch 70, a mitigating action results. Such action may include shutting down chain feed drive 30, illuminating an indicator lamp or sounding an alarm in an operator control panel, setting a code in an electronic control unit which can be queried on a regular basis, or any other suitable manner. Limit switch 70 may be coupled to an electronic device 71 which may be an electronic control unit in which a code is set, an indicator lamp, an alarm, a relay coupled to the chain feed drive 30, a wireless communication device to communicate a maintenance condition to a remote monitor, or any suitable device.

Figure 4:
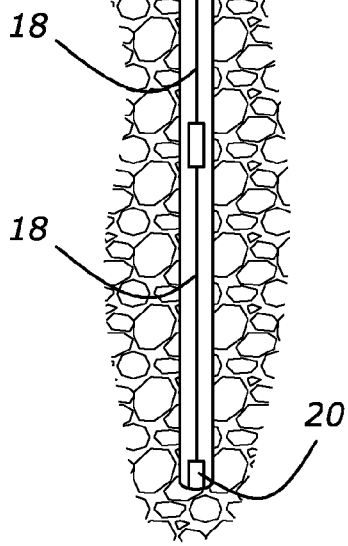
FIGS. 4 and 5 are cross-sections of guide rails on which a rock drill may move, according to embodiments of the disclosure.
Figure 4:
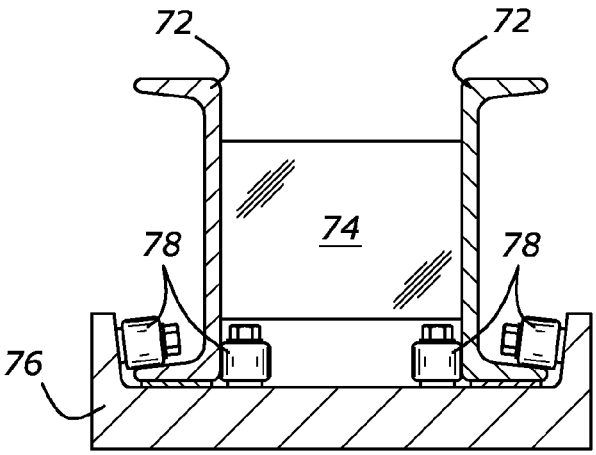
Figure 5:
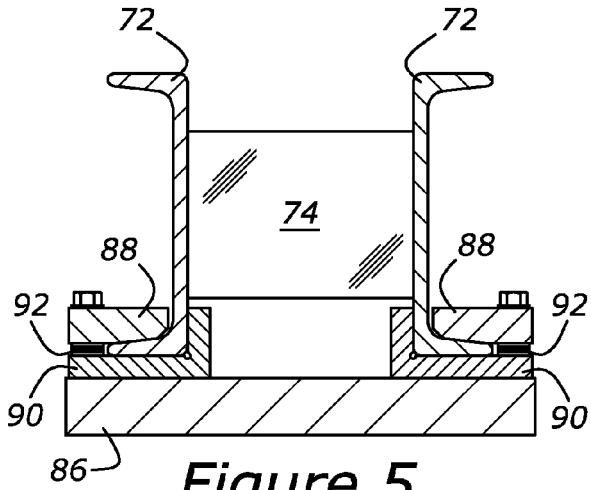

In FIG. 4, a cross-section of guide rails 72, which are a part of feed channel 14, are shown having ribs 74 to support and maintain guide rails 72 parallel to each other. FIG. 3 show one embodiment of guide rails 48 and FIGS. 4 and 5 show different embodiments of guide rails 72. A rock drill mounting base 76 is coupled to rock drill 16 (not shown in this view). The embodiment shown in FIG. 4 includes rollers 78 between guide rails 72 and rock drill mounting base 76. An outer surface of roller 78 can be made of a compressive material. Alternatively, guide rails 72 may directly contact rock drill mounting base 76 leading to metal-to-metal rubbing, such as shown in FIG. 5. The metal-to-metal contacts can be provided with lubricant and/or a sacrificial wear surface.

The embodiments shown in FIGS. 4 and 5 with two guide rails 48 are not intended to be limiting. Alternatively, a single, centrally-located guide rail could be used, or a greater number of guide rails could be used. Furthermore, the shape of the guide rails 48 indicates one possible configuration and any other suitable shapes are contemplated.

Figure 6:
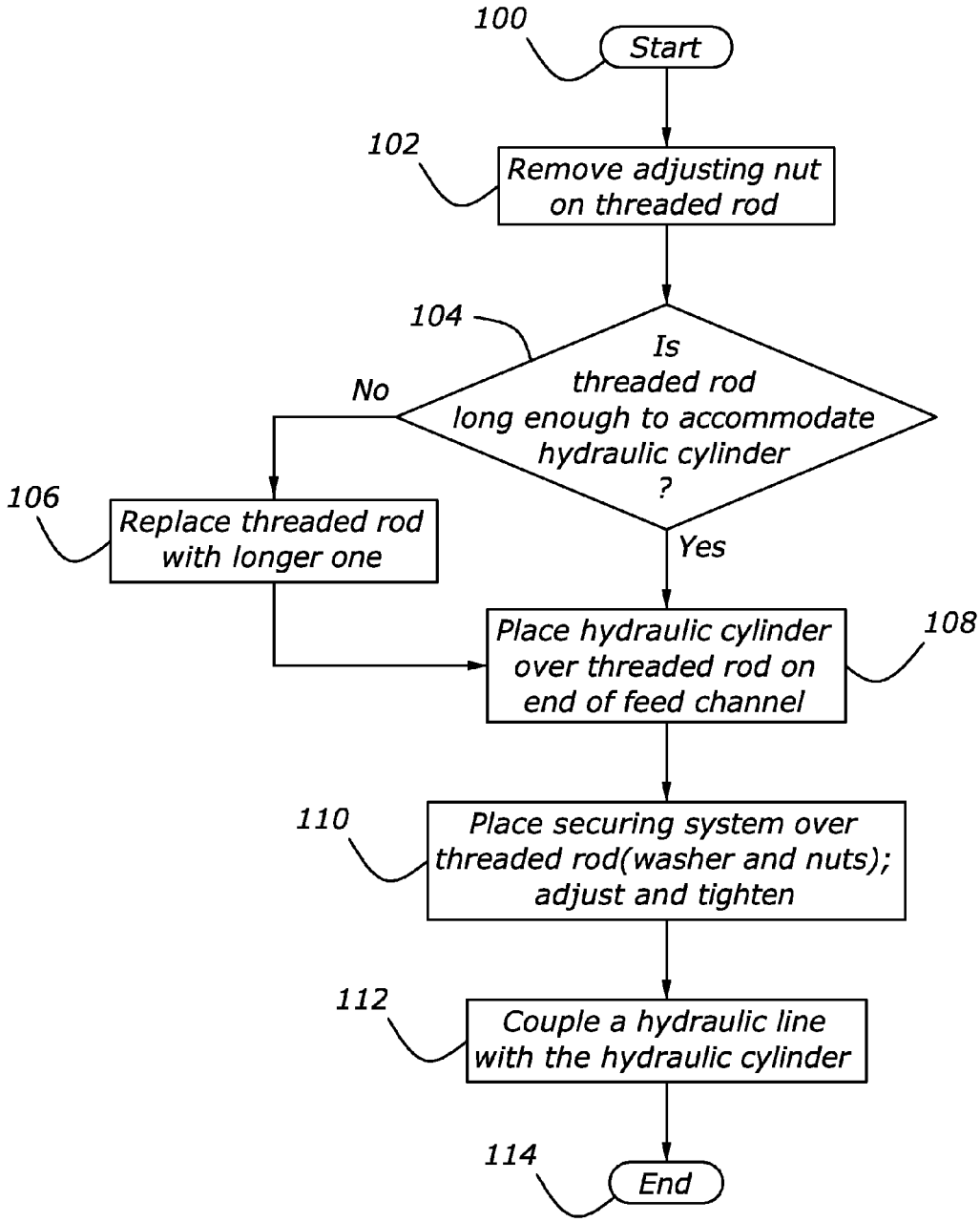
FIG. 6 is a flow chart of a method to retrofit a rock drill assembly with manual chain tension adjustment to one with automatic chain tensioning, according to an embodiment of the disclosure.

In FIG. 6, an exemplary method for retrofitting a rock drill assembly 12 with an automatic tensioner starts at block 100. In block 102, an adjusting nut (and any other nuts) on a threaded rod of a manually-adjusted system are removed. In decision block 104, it is determined whether the threaded rod is long enough to accommodate a hydraulic cylinder. If not, control passes to block 106 in which the threaded rod is replaced by a threaded rod of a longer length. Control passes to block 108 from 106 and when a positive result is yielded from decision block 104. In block 108, a hydraulic cylinder is placed over the threaded rod. In block 110, the adjusting nut (the same one from block 102 or a replacement) is placed onto the threaded rod and tightened against the hydraulic cylinder. In some embodiments, a washer is placed over the threaded rod prior to putting on the adjusting nut and/or a locking nut is placed onto the threaded rod and tightened onto the adjusting nut to lock it into place. In block 112, a hydraulic fluid line is coupled to the hydraulic cylinder and the method ends in block 114 with the retrofit being complete.

While the best mode has been described in detail, those familiar with the art will recognize various alternative designs and embodiments within the scope of the following claims. Where one or more embodiments have been described as providing advantages or being preferred over other embodiments and/or over prior art in regard to one or more desired characteristics, one of ordinary skill in the art will recognize that compromises, additions or subtractions may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. For example, the through-bore hydraulic cylinder can be placed onto the feed upper plate and held in place by the threaded rod and the accompanying nuts and washer. This provides a simple retrofit opportunity. Alternatively, the feed upper plate can be provided with mounting bosses and the through-bore hydraulic cylinder can be fixed to the feed upper plate without relying on securing it down via the threaded rod. The embodiments described as being less desirable relative to other embodiments with respect to one or more characteristics are not outside the scope of the disclosure as claimed.

What is claimed:

1. A rock drill assembly, comprising:

a feed channel having a guide rail;

a rock drill configured to translate along the guide rail;

a tensioner member movably coupled to the feed channel;

a chain feed drive fixedly coupled to the feed channel and having a drive sprocket;

a chain attached to the rock drill and engaging the tensioner member and the drive sprocket;

an actuator associated with the tensioner member and configured to apply a substantially constant tensioning force to the tensioner member to tension the chain, the actuator comprising a through-bore hydraulic cylinder with a plunger and a hydraulic fluid inlet port; and a rod coupled to the tensioner member and extending through the through-bore hydraulic cylinder;

so that when pressurized hydraulic fluid is provided to the through-bore hydraulic cylinder, the force on the plunger is transmitted to the rod thereby tensioning the chain.

2. The assembly of claim 1, further comprising: a check valve coupled to the hydraulic fluid inlet port; and a hydraulic line coupled to the check valve.

3. The assembly of claim 2, further comprising: an adjusting nut disposed on an end of the rod extending through the through-bore hydraulic cylinder.

4. The assembly of claim 1, further comprising: a mark on the feed channel and a mark on the tensioning member, such that the marks being roughly coincident indicates that the chain has stretched.

5. The assembly of claim 4, wherein the indication signifies that the chain should be replaced.

6. The assembly of claim 1, further comprising: a switch coupled to the feed channel and actuatable by the tensioner member to provide an indication of chain stretch exceeding a predetermined threshold.

7. The assembly of claim 1, wherein the tensioner member comprises a clevis and a tensioner sprocket, and the chain engages the tensioner sprocket.

8. The assembly of claim 1, further comprising: a drive idler sprocket coupled to one of the chain feed drive and the feed channel, wherein the chain further engages the drive idler sprocket.

9. The assembly of claim 1, wherein the chain has first and second ends that are attached to the rock drill such that the chain and the rock drill form a loop.

10. An automatic tensioning system for a chain-driven rock drill assembly, comprising:

a guided clevis adapted to translate along a feed channel of the rock drill assembly;

a tensioner sprocket coupled to the guided clevis;

a through-bore hydraulic cylinder mounted on one end of the feed channel and having a plunger;

a rod having a first end coupled to the guided clevis and a second end extending through the plunger; and a fastener coupled to the rod on the second end to prevent the rod from sliding through the plunger.

11. The tensioning system of claim 10 wherein the rod is a threaded rod and the fastener is an adjusting nut which engages with the threaded rod, and the system further comprises: a washer between the plunger and the adjusting nut, an outer diameter of the washer being greater than an inner diameter of the plunger so that force acting on the plunger is transmitted to the rod via the adjusting nut and washer.

12. The tensioning system of claim 10, wherein the chain-driven rock assembly has a chain which is engagable with the tensioner sprocket.

13. The tensioning system of claim 10, wherein the through-bore hydraulic cylinder includes: a hydraulic inlet port and the system further comprises a check valve coupled to the hydraulic inlet port.

14. The tensioning system of claim 13, further comprising: a hydraulic line coupled to the check valve through which pressurized hydraulic fluid is provided to the through-bore hydraulic cylinder.

15. The tensioning system of claim 10, further comprising: a hydraulic port in the through-bore hydraulic cylinder; a three-way valve coupled to the hydraulic inlet port; and a check valve coupled to the three-way valve.

16. The tensioning system of claim 15 wherein the three-way valve is manually operable to allow flow between the check valve and the hydraulic cylinder when the three-way valves is in a normal-operation position and to allow flow between the hydraulic cylinder and a bleed off line when the three-way valve is in a chain-replacement position.

17. A method for providing a rock drill assembly with an automatic tensioning system, comprising:

sliding a piston of a through-bore hydraulic cylinder over a threaded rod coupled to a guided clevis, the guided clevis coupled to a tensioning sprocket;

tightening an adjusting nut onto the threaded rod to snug up to the through-bore hydraulic cylinder; and coupling a hydraulic supply line to an inlet of the through-bore hydraulic cylinder.

18. The method of claim 17 wherein the threaded rod is part of a manually-adjusted tensioning system and the method further comprises removing a nut from the threaded rod prior to sliding the through-bore hydraulic cylinder over the threaded rod.

19. The method of claim 17 further comprising: replacing a rod of a manually-adjusted tensioning system with the threaded rod prior to sliding the through-bore hydraulic cylinder over the threaded rod, the threaded rod being longer than the rod of the manually-adjusted tensioning system to accommodate length of the through-bore hydraulic cylinder.

20. The method of claim 19, further comprising: coupling a locking nut with the threaded rod to lock the adjusting nut.

* * * * *